US005495892A

United States Patent [19]

Carisella

[11] Patent Number: 5,495,892

[45] Date of Patent: Mar. 5, 1996

[54] INFLATABLE PACKER DEVICE AND METHOD

[76] Inventor: James V. Carisella, P.O. Box 10498, New Orleans, La. 70181

[21] Appl. No.: 175,603

[22] Filed: Dec. 30, 1993

[51] Int. Cl.[6] ..... E21B 33/127

[52] U.S. Cl. ..... 166/387; 166/187; 277/34.6

[58] Field of Search ..... 166/187, 387; 277/34, 34.6; 138/93

[56] References Cited

U.S. PATENT DOCUMENTS

| | | | |
|---|---|---|---|
| 1,314,833 | 9/1919 | Sargent | 166/187 X |
| 1,402,504 | 1/1922 | Kranse | 277/34.6 X |
| 1,981,431 | 11/1934 | Seamark | 166/187 X |
| 2,804,148 | 8/1957 | Schremp et al. | 166/187 X |
| 3,160,211 | 12/1964 | Malone . | |
| 3,204,697 | 9/1965 | Gaut | 166/187 X |
| 3,460,624 | 8/1969 | Aitken et al. | 166/187 X |
| 3,527,296 | 9/1970 | Malone . | |
| 3,529,665 | 9/1970 | Malone . | |
| 3,529,667 | 9/1970 | Malone . | |
| 3,542,127 | 11/1970 | Malone . | |
| 3,575,237 | 4/1971 | Malone . | |
| 3,581,816 | 6/1971 | Malone . | |
| 3,604,732 | 9/1971 | Malone . | |
| 3,606,924 | 9/1971 | Malone . | |
| 3,776,308 | 12/1973 | Malone . | |
| 3,837,947 | 9/1974 | Malone . | |
| 3,899,631 | 8/1975 | Clark . | |
| 3,912,014 | 10/1975 | Wetzel . | |
| 3,941,190 | 3/1976 | Conover . | |
| 4,316,504 | 2/1982 | Baker et al. . | |
| 4,320,803 | 3/1982 | Manderschelid . | |
| 4,349,204 | 9/1982 | Malone | 166/187 X |
| 4,352,394 | 10/1982 | Zehren . | |
| 4,429,720 | 2/1984 | Beck et al. . | |
| 4,485,876 | 12/1984 | Speller . | |
| 4,535,843 | 8/1985 | Jageler . | |
| 4,614,346 | 9/1986 | Ito . | |
| 4,655,292 | 4/1987 | Halbardier . | |

FOREIGN PATENT DOCUMENTS

| | | | |
|---|---|---|---|
| 651648 | 11/1962 | Canada | 277/34 |
| 1014065 | 7/1977 | Canada . | |
| 1221027 | 4/1987 | Canada . | |
| 1257197 | 7/1989 | Canada . | |
| 1274721 | 10/1990 | Canada . | |
| 2008152 | 10/1990 | Canada . | |
| 2230800 | 10/1990 | United Kingdom . | |
| 2230805 | 10/1990 | United Kingdom . | |
| 2236779 | 4/1991 | United Kingdom . | |

OTHER PUBLICATIONS

Article Entitled "New Inflation Testing Packer Improved Testing Capabilities"; Petroleum Society of CIM; Paper No. 79–30–08; pp. 1–8; Author: J. Brandell et al.

Article Entitled "Pack/Perf Could Resolve Problem Completions" by J. P. Pitts; Drill Bit; pp. 84 and 85; Apr., 1980.

Article entitled "Cement–Inflated Packer To Make North Sea Debut"; Offshore Drilling Technology; pp. 31, 33; Mar., 1986.

Article Entitled "Advancements In Drill Stem Testing Through The Use Of Annular Pressure Responsive Equipment And Improvements In Open Hole Testing Through Inflatable Packer Systems" by: N. G. Hortman et al; Society of Petroleum Engineers; pp. 729–735.

Article Entitled "New Completion System Eliminates Remedial Squeeze Cementing For Zone Isolation" by: James E. Oliver; Society of Petroleum Engineers of AIME; pp. 101–105.

*Primary Examiner*—Hoang C. Dang

*Attorney, Agent, or Firm*—William C. Norvell, Jr.

[57] ABSTRACT

An inflatable packer and a method for its use are provided for introduction into a subterranean well bore on a conduit. A fold can form in the inflatable elastomeric bladder of the packer during inflation or deflation, forming a seal on the central body or mandrel which obstructs the effective passage of fluid, thereby obstructing inflation and deflation of the bladder. The packer provides a fluid path to effectively communicate pressured fluid along the entire interior length of the bladder, thus effectively tolerating the fold and any otherwise fluid-obstructing seal.

(List continued on next page.)

2 Claims, 2 Drawing Sheets

U.S. PATENT DOCUMENTS 4,708,208 11/1987 Halbardier .
4,805,699 2/1989 Halbardier .
4,832,120 5/1989 Coronado ..... 166/187
4,838,349 6/1989 Berzin .
4,840,231 6/1989 Berzin et al. .
4,928,759 5/1990 Siegfried, II et al. .
4,934,460 6/1990 Coronado .
4,936,387 6/1990 Rubbo .
4,941,534 7/1990 Vel Berzin .
4,951,747 8/1990 Coronado ..... 166/187
4,962,812 10/1990 Vel Berzin .
4,962,815 10/1990 Schultz et al. .
4,979,570 12/1990 Mody ..... 166/387
5,020,600 6/1991 Coronado .
5,044,444 9/1991 Coronado .
5,101,908 4/1992 Mody .
5,109,926 5/1992 Mody et al. .
5,133,412 7/1992 Coronado .
5,143,154 9/1992 Mody et al. .
5,242,019 9/1993 Benker .
5,265,679 11/1993 Coronado et al. .

FIG. 1
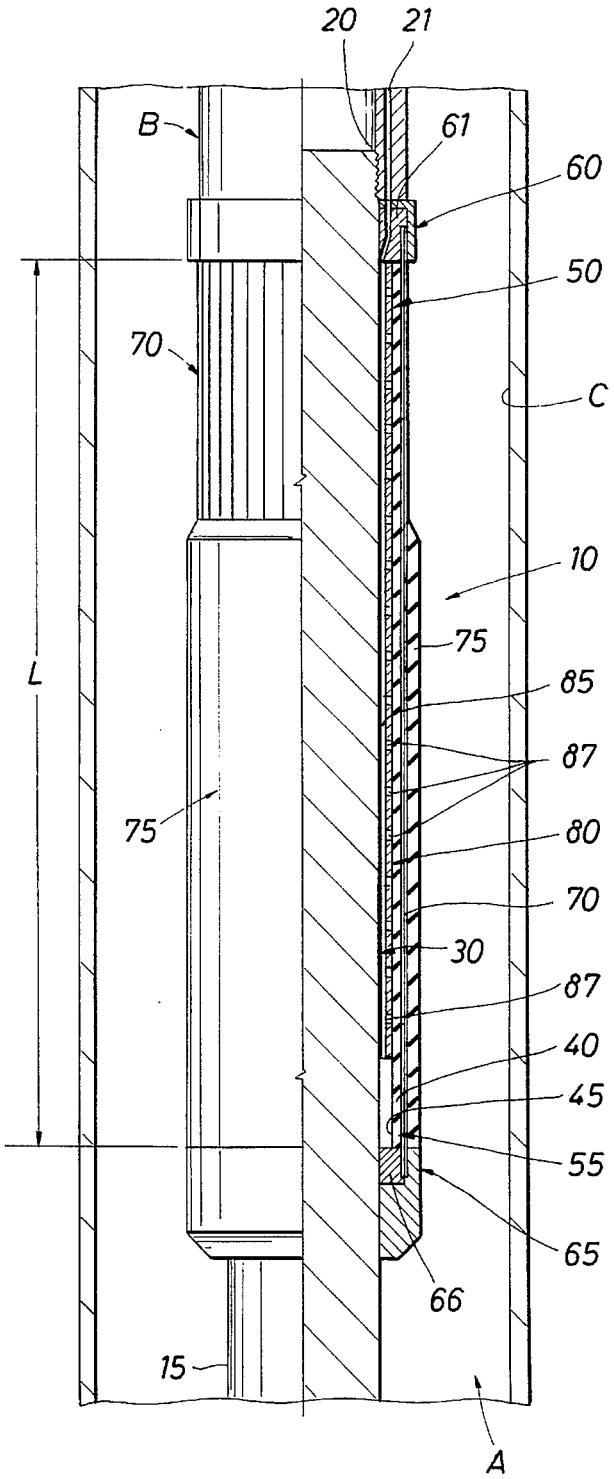
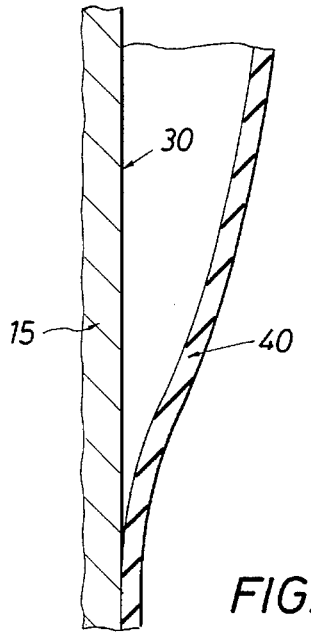
FIG. 3A
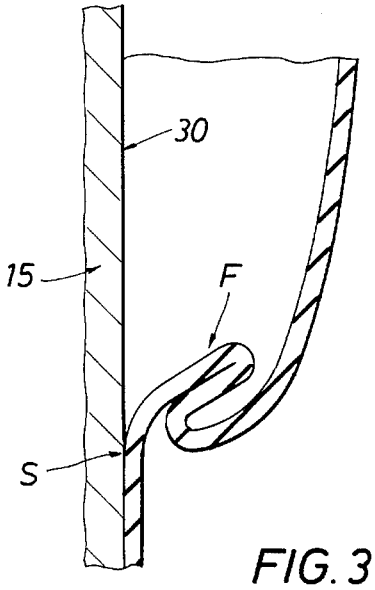
FIG. 3C

INFLATABLE PACKER DEVICE AND METHOD

CROSS REFERENCE TO RELATED APPLICATIONS

This application is generally related in subject matter to the following applications: Ser. No. 08/175,607, filed Dec. 30, 1993, entitled Inflatable Packer Device Including Limited Initial Travel Means And Method, now U.S. Pat. No. 5,417,289; and Ser. No. 08/175,974, filed Dec. 30, 1993, entitled Programmed Shape Inflatable Packer Device And Method.

BACKGROUND OF THE INVENTION

1. Field of the Invention

The invention relates to an inflatable packer device, such as a packer, bridge plug, or the like, for use in a subterranean well bore, and a method of using same.

2. Description of the Prior Art

Inflatable packers, bridge plugs, and the like have long been utilized in subterranean wells. Such inflatable tools normally comprise an inflatable elastomeric bladder element concentrically disposed around a central body portion, such as a tube or mandrel. Pressured fluid is communicated from the top of the well or interior of the well bore to the bore of the body and thence through radial passages to the interior of the bladder element or, alternatively, around the exterior of the body such as when the body is solid.

Normally, an upper securing means engages the upper end of the inflatable elastomeric bladder, sealably securing the upper end of the bladder relative to the body, while a lower securing means engages the lower end of the bladder, sealably and slidably securing the lower end of the bladder for slidable and sealable movement on the exterior of the body, in response to the inflation forces.

With inflatable packers of this type, it has been observed that the exposed anchor section of the packer inflates prior to the other sections of the packer which are reinforced against expansion by an elastomeric packing sleeve element. When an exposed portion, such as the exposed anchor section of the bladder, inflates, the lower end of the bladder moves upwards relative to the body, and the exposed portion inflates until it meets the wall of the well bore, which may be cased or uncased. If well bore is uncased, the well bore will have a wall, and if the well bore is cased, the wall of the well bore will be the interior of the casing.

Although not fully understood, as the inflation begins to propagate downward and the reinforced portions of the bladder begin to inflate, the bladder has a propensity to pinch around the exterior of the body, creating a seal that prevents the effective communication of further fluid to the lower portions of the bladder. As the upper portion of the bladder above the seal continues to inflate, a convoluted fold forms in the bladder at the point of the seal, thus entrenching the seal.

This propensity to seal and fold are referred to in this application and the claims and the description of the preferred embodiment herein as a "capacity to seal". The seal prevents or obstructs passage of the pressured fluid, employed for inflating the inflatable bladder, from reaching the lower portions of the bladder. Further, if the bladder is successfully inflated, the convoluted fold often remains in the bladder. During deflation, this fold can similarly pinch and seal around the body, obstructing the communication of fluid out of the lower portions of the bladder and thereby preventing complete deflation of the bladder.

Applicant is aware of the following additional prior art: U.S. Pat. Nos. 4,349,204, 4,832,120, 4,951,747, and 4,979,570.

The present invention addresses the problems set forth above by providing an inflatable packer device and method of use wherein a fluid path means effectively communicates pressured fluid along the entire interior length of the bladder, allowing complete inflation and deflation of all portions of the bladder, whether or not a seal has formed, thus tolerating the otherwise fluid-obstructing seal.

SUMMARY OF THE INVENTION

The present invention provides an inflatable packer device and method of use thereof with the packer being introduceable into a subterranean well bore on a conduit, such packer being inflatable by pressured fluid communicated to the packer from an available source of pressured fluid. The well may be cased or uncased hole. If well bore is uncased, the well bore will have a wall, and if the well bore is cased, the wall of the well bore will be the interior of the casing.

The packer has a body, with means on its upper end for selective engagement to the conduit. An inflatable elastomeric bladder is concentrically disposed around the exterior of the body, which is selectively movable between deflated and inflated positions, by the application of pressured fluid applied to the interior of the bladder. The pressured fluid is communicated via a fluid transmission means from the source of pressured fluid, either to the bore of the body and thence through radial passages, or around the exterior of the body, and thence to the interior of the bladder. By the application of this pressured fluid, the bladder may be moved between deflated and inflated positions, so that the inflatable packer device may be moved into or out of sealing engagement with the wall of the well bore.

A first securing means engages one end of the bladder for sealably securing the bladder end to the body, while a second securing means engages the other bladder end of the bladder for sealably securing the other bladder end to the body. At least one of these securing means enables the bladder end to which it is engaged to move slidably relative to the body, in response to the inflation or deflation forces.

Finally, a fluid path means is disposed along the entire length of the interior of the bladder, whereby any fold and seal formed as mentioned above does not obstruct the effective communication of the pressured fluid along the length of the interior of the bladder, allowing full inflation of the packer. Thus, the otherwise fluid-obstructing fold and seal is tolerated.

BRIEF DESCRIPTION OF THE DRAWINGS

FIG. 1 is a half-sectional elevational view of an inflatable packer device embodying this invention, with the elements of the packer shown inserted in a subterranean well bore in their non-inflated positions, prior to actuation for setting in the well bore.

FIGS. 3A through 3C are similar, partial cross-sectional elevational views of a portion of a prior art packer showing the formation of the problematic fold and seal.

DESCRIPTION OF THE PREFERRED EMBODIMENTS

Figure 2:
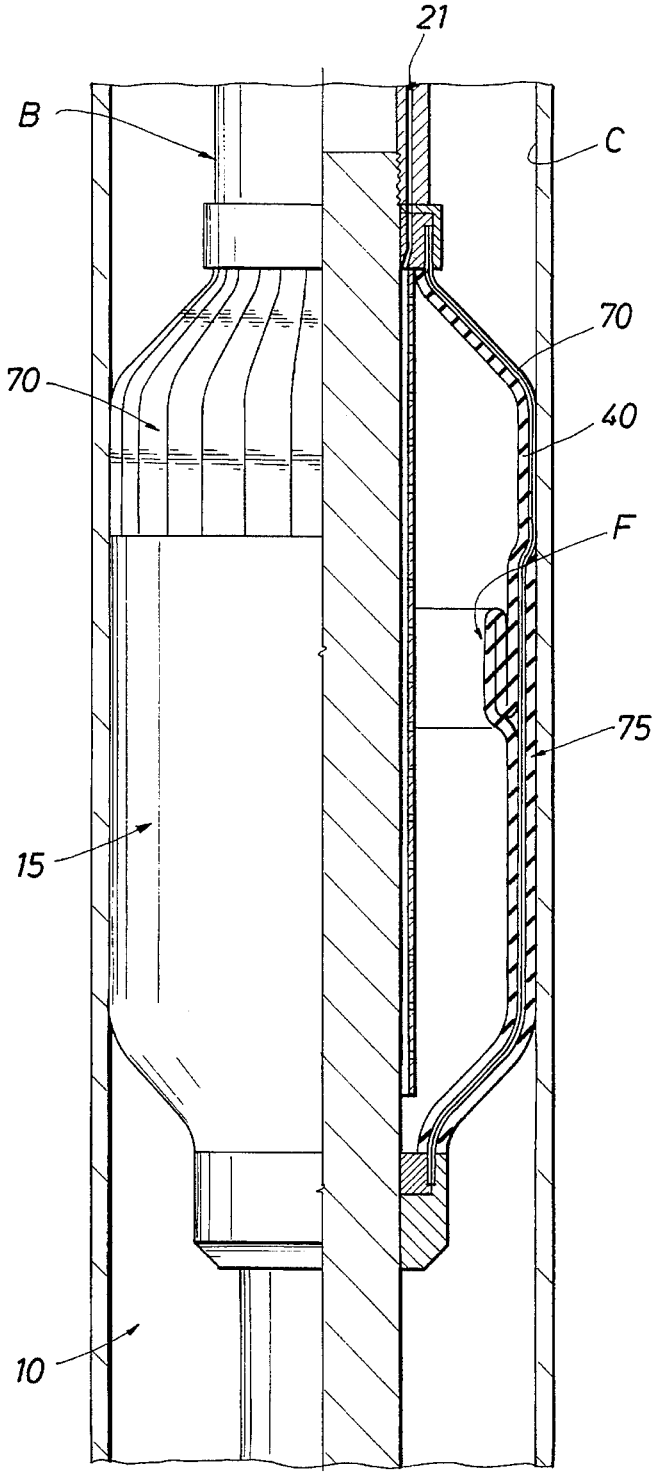
FIG. 2 is a view similar to that of FIG. 1 showing the inflatable packer device subsequent to inflation in its set mode, sealably engaged with the well bore casing.

Now referring to the figures and in particular to FIG. 1, there is shown an inflatable packer device 10. The packer 10 may be provided in the form of a packer, bridge plug, tubing hanger, cement retainer, or the like, depending upon whether or not the bore of the packer is open or closed.

The packer 10 contains a body 15 which may be provided, as shown, in the form of a solid cylindrical element. The body 15 extends through the full length of the packer 10 and connects to the bottom of a conduit B, such as tubing in the form of a continuous length coiled tubing, or the like, which extends to the well surface (not shown). The conduit B may also be provided in the form of wire or electric line, or sectioned, threaded drill or production pipe, or casing. The body 15 is connected to the bottom of the conduit B by means on its upper end such as a threaded surface 20 engageable with conduit B.

A tube 80 is concentrically disposed around the body 15. The inner diameter of the tube 80 is larger than the outer diameter of the body 15 so that an annular gap 85 is formed between the body 15 and tube 80. An inflatable elastomeric bladder 40 is concentrically disposed around the tube 80. The bladder may be surrounded and secured relative to a reinforcing sheath 70. The sheath 70 may be formed of a plurality of longitudinally extending slats or ribs which are of a suitable length so that they generally extend beyond each of the ends of the bladder 40 with each of the longitudinally extending ribs circumferentially overlapping an adjacent rib. The width of such ribs and their arrangement in forming the sheath 70 is such that each of the ribs will overlap the next adjacent rib when the bladder 40 is deflated and each rib will adequately overlap the next adjacent rib when the inflatable bladder 40 is inflated, thus forming a reinforcing sheath 70 for the inflatable bladder 40 at all times.

The exterior of the reinforcing sheath 70 is either partially or completely surrounded and bonded to an outer annular elastomeric packing sleeve 75.

The first bladder end 50 and sheath 70 are sealably secured to the body 15 by a first securing means, such as a collar 60 and binding sleeve 61 mounted to the body just above the top of the tube 80. The second bladder end 55 and sheath 70 are sealably secured to the body 15 by a second securing means, such as a collar 65 and binding sleeve 66 mounted to the body near the bottom of the tube 80. The second securing means, which comprises the collar 65 and sleeve 66, is also engaged for sealable movement slidably relative to the body 15, in response to the inflation forces.

The tube 80 extends from the collar 60 and binding sleeve 61 to just above the collar 65 and binding sleeve 66, leaving sufficient distance between the bottom of the tube 80 and the collar 65 when the packer is uninflated so that the collar 65 and binding sleeve 66 do not strike the tube 80 when the collar 65 and sleeve 66 slide upwards during inflation of the bladder 40. The tube 80 further contains a plurality of fluid passageways 87 along substantially the entire length of the interior 45 of the bladder 40 for communication of pressured fluid to the bladder 40. The bladder 40 is selectively movable between deflated and inflated positions by the introduction of pressured fluid through a fluid transmission means such as a plurality of channels 21 in the collar 60 and binding sleeve 61. The pressured fluid is communicated in a known and conventional manner from the source of pressured fluid (not shown), through the channels 21 to the annular gap 85, and further through the plurality of fluid passageways 87 in the tube 80, to the interior 45 of the bladder 40. By the application of pressured fluid to the interior 45 of the bladder 40, the packer 10 may be inflated and thus moved into sealing engagement with the casing wall C of the well bore A, as shown in FIG. 2. The well bore A may be cased or uncased, and is shown cased in the figures. If well bore A is uncased, the well bore A will have a wall, and if the well bore A is cased, as shown, the wall of the well bore A will be the interior of the casing C.

The packer 10 is lowered into the top (not shown) of the well bore A on the conduit B to a pre-determinable position. At this position the packer 10 may be moved into sealing engagement with the well bore casing C by the introduction of pressured fluid communicated to the packer 10 from a source of pressured fluid (not shown) located at the top of or within the well bore A. FIG. 1 shows the packer 10 in the well bore A after being lowered into the well bore A and before the packer 10 is actuated for setting in the well bore A.

Figure 3B:
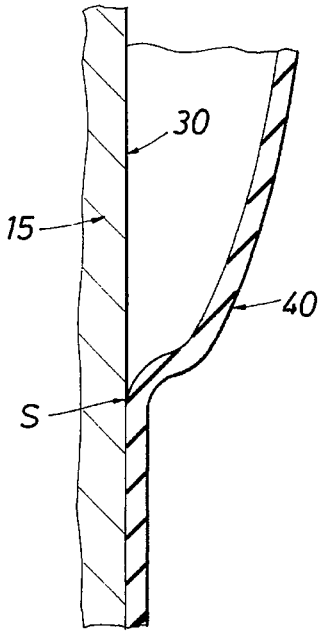

Referring now to FIG. 2, which shows the packer 10 after actuation and in sealing engagement with the casing C of the well bore A, during inflation or deflation of the bladder 40, the bladder 40 has a capacity to seal and form a fold F around the tube 80. As illustrated in FIGS. 3A through 3C, which show the formation of the problematic seal S and fold F in a prior art packer, without the presence of the tube 80 shown in FIG. 2 the bladder 40 of the prior art packer in FIGS. 3A–3C would, during inflation or deflation, pinch and form a seal S and fold F around the exterior surface 30 of the body 15, thereby obstructing passage of the pressured fluid between portions of the bladder 40 above and below the seal S, thereby obstructing complete inflation or deflation of the bladder 40. It will be noted that two or more seals S and folds F may form during inflation of the bladder 40 depending upon the construction of the packer 10.

The tube 80 as shown in FIG. 2 therefore forms a fluid path means which allows the effective communication of pressured fluid along the entire length of the interior 45 of the bladder 40, allowing complete inflation and deflation of all portions of the bladder 40, whether or not a seal S has formed, thereby tolerating the otherwise fluid-obstructing seal S when the bladder 40 inflates or deflates.

Rather than use a tube 80, the fluid path means may also comprise a longitudinal fluted groove in the surface of the body 15, extending between both ends of the bladder 40, to communicate pressured fluid through the groove, along the entire length of the interior 45 of the bladder 40, despite the existence of the seal S initially formed around the exterior 30 of the body 15. Additionally, the fluid path means may also be formed by a relatively small tube disposed adjacent to and parallel with the body 15 and interior to the bladder 40, where the tube has a plurality of fluid passageways for communication of pressured fluid along the entire length of the interior 45 of the bladder 40. The fluid path means may also comprise a plurality of fluid passageways defined in the body 15 communicable with the bore 18 of the body 15 for communication of pressured fluid along the entire length of the interior 45 of the bladder 40. It will be appreciated that alternative embodiments of the invention may employ other fluid path means, such as various forms of grooves, channels or tubing defined in or concentrically surrounding or exterior to the body 15.

After actuation of the packer 10, the packer may be deflated and thereupon removed from the well bore A or moved to a new pre-determinable position within the well bore A for subsequent actuation.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. An inflatable packer device for use in a subterranean well bore having a wall and carryable into said well bore on a conduit, said inflatable packer device being inflatable by pressured fluid communicated to the packer from a source of pressured fluid, said inflatable packer device comprising:

(a) a body having means on its upper end for selective engagement to said conduit, said body further having an exterior surface;

(b) an inflatable elastomeric bladder concentrically disposed around said body, said bladder having an interior, the bladder further having a first bladder end and a second bladder end, the interior of said bladder further having a length extending between the bladder ends, the bladder further being selectively movable between deflated and inflated positions, the bladder further having a capacity to seal around the exterior surface of said body during at least one of inflation or deflation of the bladder;

(c) first securing means engageable with one of said bladder ends for sealably securing said bladder end to said body;

(d) second securing means engageable with the other of said bladder ends for sealably securing said other bladder end to said body at least one of said first and second securing means enabling at least one of said bladder ends to move slidably relative to said body during inflation and deflation of said bladder;

(e) fluid transmission means for communicating said pressured fluid between the source of pressured fluid and the interior of said bladder to move the bladder between each of deflated and inflated positions, whereby the inflatable packer device may be moved into one of sealing and unsealing relationship with the wall of the well bore; and (f) fluid path means disposed along said length of said interior of said bladder for communicating said pressured fluid along said length of said interior of said bladder, whereby said seal does not obstruct the effective communication of said pressured fluid along the length of said interior of said bladder, wherein said fluid path means comprises a tube concentrically disposed between said body and said bladder, said tube having an inner diameter, said body having an outer diameter, and further, said inner diameter of said tube being larger than said outer diameter of said body, whereby an annular gap is formed between said tube and said body, said tube further having a plurality of fluid passageways disposed therethrough along said length of said interior of said bladder, whereby said plurality of fluid passageways and said annular gap define a path for communication of pressured fluid along the length of said interior of said bladder.

2. Method of sealing a portion of a subterranean well bore having a wall, comprising the steps of:

(a) assembling at the top of the well a conduit having affixed thereon an inflatable packer device carryable into said well bore on a conduit said inflatable packer device being inflatable by pressured fluid communicated to said packer from a source of pressured fluid, said inflatable packer device comprising:

(1) a body having means on its upper end for selective engagement to said conduit, said body further having an exterior surface;

(2) an inflatable elastomeric bladder concentrically disposed around said body, said bladder having an interior, the bladder further having a first bladder end and a second bladder end, the bladder further being selectively movable between deflated and inflated positions, the bladder further having a largest circumference and a smallest circumference at any given time;

(3) first securing means engageable with one of said bladder ends for sealably securing said bladder end to said body;

(4) second securing means engageable with the other of said bladder ends for sealably securing said other bladder end to said body, at least one of said first and second securing means enabling at least one of said bladder ends to slidably move relative to said body during inflation of said bladder;

(5) fluid transmission means for communicating said pressured fluid between the source of pressured fluid and the interior of said bladder to move the bladder between each of deflated and inflated positions, whereby the inflatable packer device may be moved into one of sealing and unsealing relationship with said wall of said well bore;

(6) a series of shape-controlling means disposed along the length of said bladder for causing substantially uniform axial inflation of said bladder whereby the ratio of the largest circumference of the bladder to the smallest circumference of the bladder during inflation is reduced and prevented from exceeding a pre-determined maximum ratio;

(b) running said inflatable packer device on said conduit within said well bore to a pre-determinable position within said well bore; and (c) actuating said inflatable packer device by introduction of said pressured fluid to the interior of said bladder, whereby said inflatable packer device moves into sealing engagement with said well bore at said position, said fluid path means comprises a tube concentrically disposed between said body and said bladder, said tube having an inner diameter, said body having an outer diameter, and further, said inner diameter of said tube being larger than said outer diameter of said body, whereby an annular gap is formed between said tube and said body, said tube further having a plurality of fluid passageways disposed therethrough along said length of said interior of said bladder, whereby said plurality of fluid passageways and said annular gap define a path for communication of pressured fluid along the length of said interior of said bladder.

* * * * *